US011243024B2

(12) United States Patent
Wang et al.

(10) Patent No.: US 11,243,024 B2
(45) Date of Patent: Feb. 8, 2022

(54) REFRIGERATOR WITH LIFTING SHELF

(71) Applicant: HISENSE (SHANDONG) REFRIGERATOR CO., LTD., Qingdao (CN)

(72) Inventors: Renhua Wang, Qingdao (CN); Shudong Zhang, Qingdao (CN); Qiuju Zhang, Qingdao (CN); Naiyu Shen, Qingdao (CN); Liyun Li, Qingdao (CN)

( * ) Notice: Subject to any disclaimer, the term of this patent is extended or adjusted under 35 U.S.C. 154(b) by 0 days.

(21) Appl. No.: 17/183,656

(22) Filed: Feb. 24, 2021

(65) Prior Publication Data

US 2021/0180855 A1 Jun. 17, 2021

Related U.S. Application Data

(63) Continuation of application No. PCT/CN2020/096951, filed on Jun. 19, 2020.

(51) Int. Cl.

| | |
|---|---|
| ***F25D 25/02*** | (2006.01) |
| ***F25D 25/04*** | (2006.01) |
| *A47B 57/06* | (2006.01) |

(52) U.S. Cl.

CPC ..... *F25D 25/024* (2013.01); *F25D 25/04* (2013.01); *A47B 57/06* (2013.01); *F25D 2325/021* (2013.01)

(58) Field of Classification Search

CPC ..... F25D 25/024; F25D 25/04; A47B 57/06

See application file for complete search history.

(56) References Cited

FOREIGN PATENT DOCUMENTS

| | | | | |
|---|---|---|---|---|
| CN | 106642961 A | * | 5/2017 | |
| CN | 112648770 A | * | 4/2021 | |
| JP | 2018200160 A | * | 12/2018 | ..... B66F 7/02 |
| KR | 100495156 B1 | * | 6/2005 | |

* cited by examiner

*Primary Examiner* — Kimberley S Wright
(74) *Attorney, Agent, or Firm* — W&KIP

(57) ABSTRACT

The present disclosure provides a refrigerator with a lifting shelf, including a lifting shelf, a shelf driving mechanism, and a shelf stroke detection device. The shelf driving mechanism includes: a driving motor and a gear transmission mechanism, where the gear transmission mechanism includes at least one group of transmission gears, the driving motor outputs a torque through a driving output shaft, and a first pulley is disposed on the driving output shaft; a guide rail slidably connected to a support piece on the guide rail, wherein the lifting shelf is fixedly connected with the support piece; and a traction cable, where the traction cable is wound around the first pulley, and the other end of the traction cable is fixedly connected with the support piece.

10 Claims, 13 Drawing Sheets

REFRIGERATOR WITH LIFTING SHELF

CROSS REFERENCE TO RELATED APPLICATIONS

This application a continuation of International Patent Application No. PCT/CN2020/096951 with a filing date of Jun. 19, 2020, designating the United States, now pending, and further claims priority to Chinese Patent Application No. 201910816671.8, titled as REFRIGERATOR WITH LIFTING SHELF, filed on Aug. 30, 2019, and Chinese Patent Application No. 201921432625.X titled as REFRIGERATOR WITH LIFTING SHELF, filed on Aug. 30, 2019, the entire contents of which are incorporated herein by reference.

TECHNICAL FIELD

The present disclosure relates to the field of intelligent household appliances and in particular to a refrigerator with a lifting shelf.

BACKGROUND

Along with increasing living quality, multi-door refrigerators with features such as high capacity, multiple functions and classified storage have an increasing share on market. Further, people have higher and higher requirements for the intelligence of the refrigerator products.

The shelves of the existing refrigerator products are mostly fixed shelves. Generally, liner ribs are formed on opposing sides of a refrigerator inner liner and the shelves are placed on the liner ribs. In order to help users to adjust, several liner ribs are generally reserved during refrigerator designing to allow adjusting the position of the shelves. However, the height between shelves is not suitable for placing articles with different volumes, bringing limitation to storage space. Further, the space utilization rate of the interior of the refrigerator is low and many foods with large volumes cannot be placed in, affecting the user experiences. In addition, in recent years, the increasing demand for refrigerators with high capacity causes the height of the refrigerator to have a trend to increase. In this case, the difficulty in taking articles from the shelf of the highest level in a refrigerator has become a problem to be solved for users.

SUMMARY

There is provided a refrigerator with a lifting shelf, including a storage compartment. A lifting shelf, a shelf driving mechanism for driving the lifting shelf to move up and down and a shelf stroke detection device for detecting a maximum moving stroke of the lifting shelf are disposed in the storage compartment. The shelf driving mechanism includes a driving motor and a gear transmission mechanism, where the gear transmission mechanism includes at least one group of transmission gears, the driving motor outputs a torque by a driving output shaft and a first pulley is disposed on the driving output shaft; a guide rail fixed in the storage compartment, where the guide rail is slidably connected to a support piece on the guide rail, and the lifting shelf is fixedly connected with the support piece; and a traction cable, where the traction cable is wound around the first pulley, and the other end of the traction cable is fixedly connected with the support piece. The shelf stroke detection device includes a stroke switch where a trigger portion is disposed on the stroke switch; and a linkage piece where the linkage piece cooperates with the stroke switch and the transmission gear respectively, a positioning portion is disposed on an inner wheel surface of the transmission gear, and when the driving motor drives the transmission gear to rotate until the positioning portion is in contact with the linkage piece, the linkage piece triggers the trigger portion of the stroke switch.

BRIEF DESCRIPTION OF THE DRAWINGS

In order to describe the technical solution of the present disclosure more clearly, the accompanying drawings involved in the examples will be briefly introduced. Apparently, those skilled the art may also obtain other drawings according to these drawings without paying creative work. Further, the accompanying drawings described below can be deemed as illustrative rather than limiting of actual sizes of the products involved in the examples of the present disclosure.

DETAILED DESCRIPTION OF THE EMBODIMENTS

Figure 1:
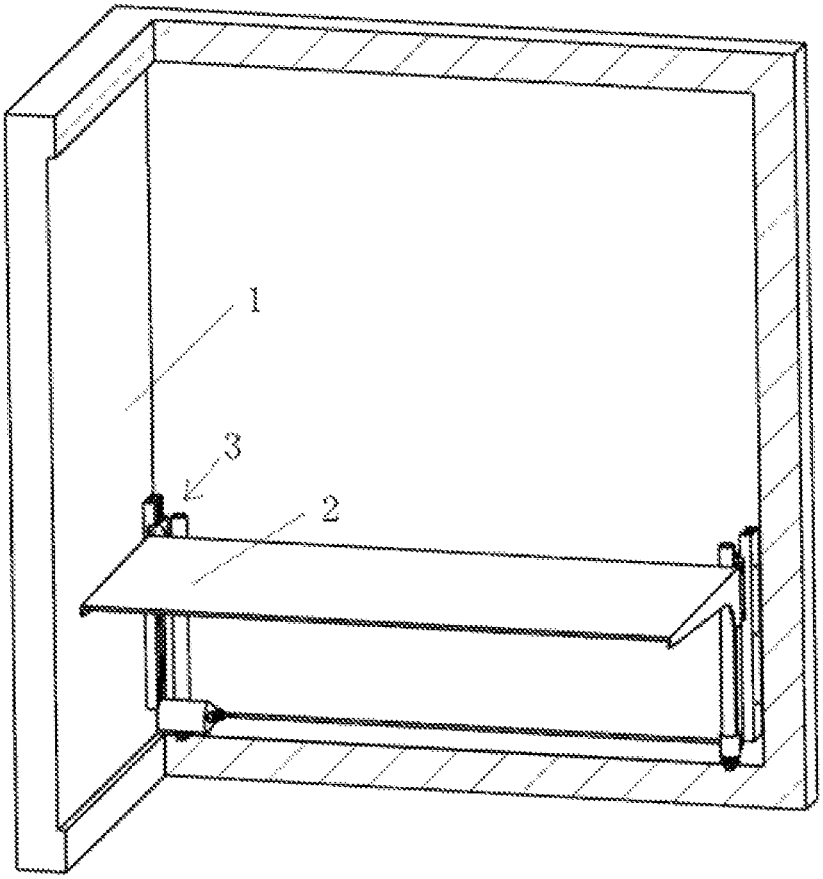
FIG. 1 is a refrigerator with an automatic lifting shelf according to one or more examples of the present disclosure.

The technical solution of the present disclosure will be fully and clearly described below in combination with the accompanying drawings of the examples of the present disclosure. Apparently, the described examples are merely some of the present disclosure rather than all examples. All other examples obtained by those skilled in the art based on these examples of the present disclosure without paying creative work shall fall with the scope of protection of the present disclosure.

In the description of the present disclosure, it is to be understood that orientations or positional relationships indicated by terms such as "center", "upper", "lower", "left", "right", "vertical", "horizontal", "inside", "outside", are based on orientations or positional relationships shown in the drawings and are used only for convenience and simplification of descriptions of the present disclosure, rather than indicate or imply that the indicated apparatus or element shall have a specific orientation and be configured or operated in a specific orientation. Thus, the terms shall not be understood as limiting of the present disclosure. In addition, the terms "first", "second" and "third" are used only for descriptions and shall not be understood as indicating or implying relative importance.

In the descriptions of the present disclosure, it is noted that the terms "mounting" "connection" and "coupling" shall be understood in a broad sense, for example, it may be a fixed connection, or a detachable connection, or integrated connection; or direct connection or an indirect connection through an intermediate medium, or may be internal communication between two elements. Those skilled in the art may understand the specific meanings of the above terms in the present disclosure according to the specific situations.

In addition, the technical features involved in the different examples described below may be combined with each other as long as they do not constitute conflict.

Figure 2:
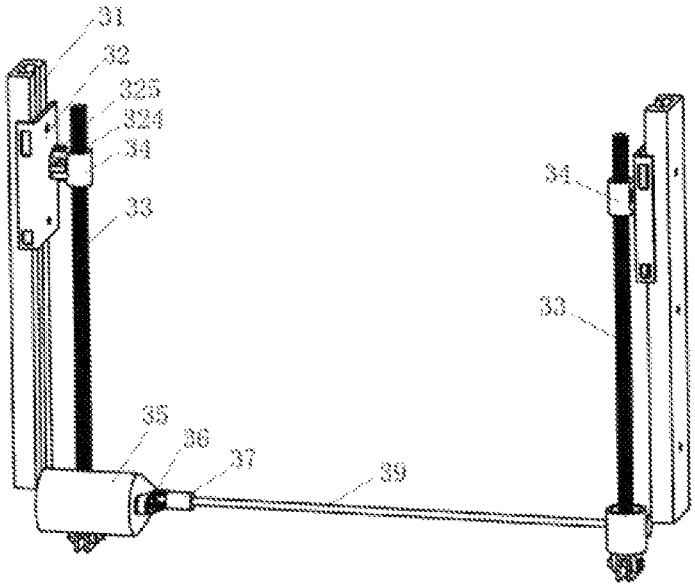
FIG. 2 is a schematic diagram of a driving mechanism of an automatic lifting shelf according to one or more examples of the present disclosure.

FIG. 1 is a refrigerator with an automatic lifting shelf according to one or more examples of the present disclosure. FIG. 2 is a schematic diagram of a driving mechanism of an automatic lifting shelf according to one or more examples of the present disclosure. As shown in FIGS. 1 and 2, a mechanism for driving a shelf to ascend and descend includes a screw rod 33 and a nut 34. A power part drives the screw rod 33 to rotate so as to realize rectilinear up and down movement of the nut 34. The nut 34 is connected with a housing 321 of a sliding block assembly 32 to drive the sliding block assembly 32 to move up and down along a guide rail 31. The power part includes a motor 35, a first rotary shaft 38, and a second rotary shaft 39. An output shaft of the motor 35 is connected with the first rotary shaft 38 through a belt 36 to bring the first rotary shaft 38 to rotate. A side of the first rotary shaft 38 transmits rotational movement to the screw rods 33 of one group of lifting mechanisms through a worm gear pinion transmission mechanism. Such automatic shelf-lifting device is converted into rectilinear movement by driving the worm gear mechanism and the screw rod nut mechanism using a motor. The device is complex in structure, and the worm gear mechanism and the screw rod nut mechanism both occupy a larger space, thereby affecting the effective storage space of the storage compartment.

Figure 3:
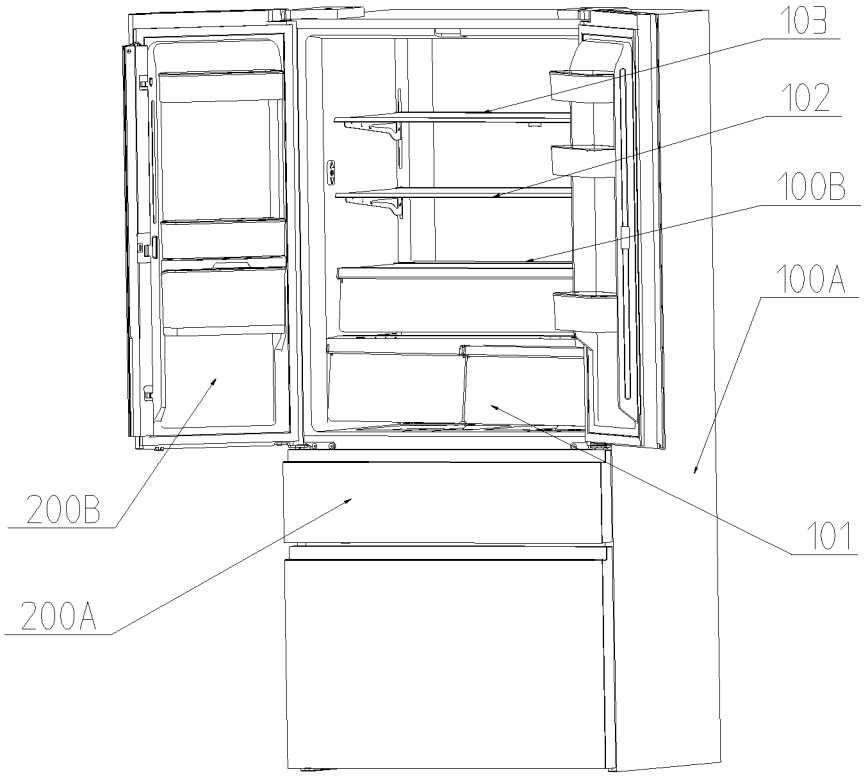
FIG. 3 is a perspective diagram of a refrigerator with an automatic lifting shelf according to one or more examples of the present disclosure.

FIG. 3 is a perspective diagram of a refrigerator with an automatic lifting shelf according to one or more examples of the present disclosure. As shown in FIG. 3, the refrigerator 1 has an approximate cuboid box shape, and its external appearance is defined by a storage compartment 100 defining a storage space and a plurality of doors 200 disposed in the storage compartment 100. The storage compartment has an open box body which is formed by a storage compartment inner liner, a storage compartment housing and a foaming layer therebetween. The storage compartment 100 is vertically divided into a lower freezing compartment 100A and an upper cold storage compartment 100B. Each of the partitioned spaces has an independent storage space.

In an example, the freezing compartment 100A is defined at a lower side of the storage compartment 100 and selectively covered by a drawer-type freezing compartment door 200A. The spaced defined above the freezing compartment 100A is divided into left and right sides to respectively define the cold storage compartment 100B. The cold storage compartment 100B may be opened or closed selectively by a cold storage compartment door 200B pivotably mounted on the cold storage compartment 100B.

In the examples of the present disclosure, the storage compartment 100 includes a storage drawer 101 at a lower side. The storage drawers are arranged in two levels, including two dry and wet preservation drawers at the lower level and a wide storage drawer that is at the upper side of the dry and wet preservation drawers and used for storing longer food materials. The storage compartment 100 further includes a shelf on the storage drawer 101. The shelf includes a fixed shelf 102 and a lifting shelf 103. The fixed shelf is a shelf that cannot be moved up and down after being mounted. Generally, liner ribs are formed on inner walls of two sides of the storage compartment 100, and the fixed shelf 102 is placed on the liner ribs. The lifting shelf 103 is a shelf adjustable up and down after being mounted. Specifically, the lifting shelf 103 is moved up and down under the drive of a shelf driving mechanism 300.

The relative positions of the lifting shelf 103 and the fixed shelf 102 are not fixed, that is, the fixed shelf 102 may be at the upper side or the lifting shelf 103 is at the upper side. In this example, the lifting shelf 103 is preferably at the upper side. In this case, when the height of the refrigerator is high and a user cannot place food materials on the shelf of the highest level, the user may store food materials by moving down the lifting shelf 103, facilitating user operation.

Figure 4:
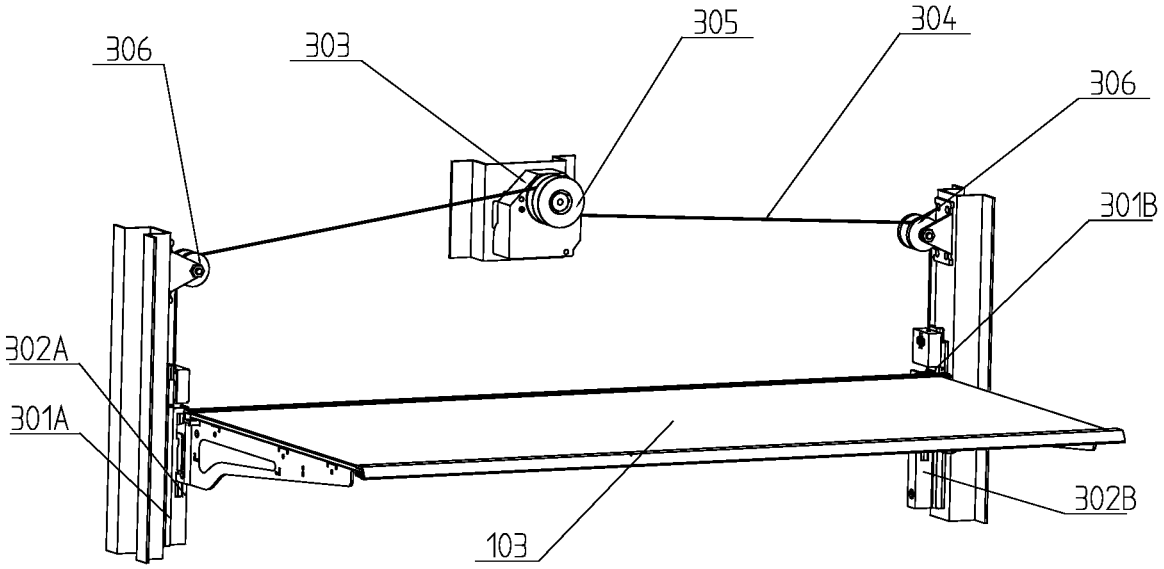
FIG. 4 is a schematic diagram of three-dimensional structure of a shelf driving mechanism of a lifting shelf according to one or more examples of the present disclosure.
Figure 5:
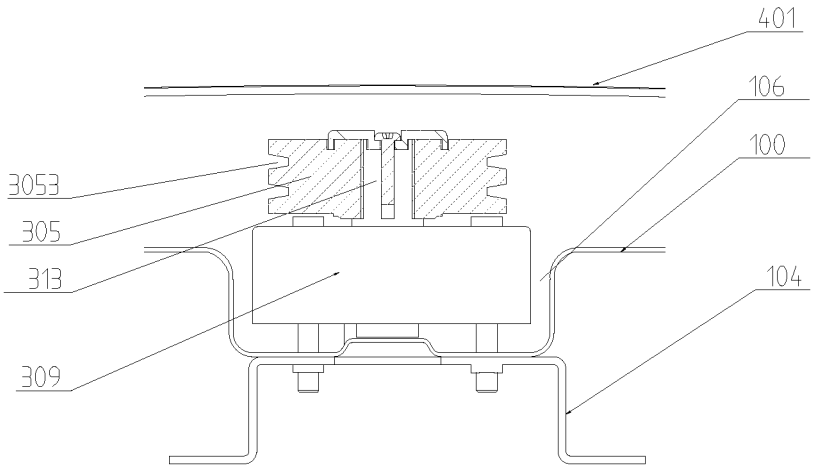
FIG. 5 is a schematic diagram of mounting structure of a driving motor according to one or more examples of the present disclosure.

FIG. 4 is a schematic diagram of three-dimensional structure of a shelf driving mechanism of a lifting shelf according to one or more examples of the present disclosure. FIG. 5 is a schematic diagram of mounting structure of a driving motor according to one or more examples of the present disclosure. As shown in FIGS. 4 and 5, the shelf driving mechanism 300 includes a guide rail 301 fixed in the storage compartment 100, and a support piece 302 slidably connected to the guide rail 301. The lifting shelf 103 and the support piece 302 are fixed connected. The shelf driving mechanism 300 further includes a motor assembly for driving the support piece to ascend and descend. The motor assembly includes a driving motor 303 and a gear transmission mechanism. The driving motor 303 outputs a driving torque by a driving output shaft 313 after being reduced by the gear transmission mechanism. A traction cable 304 is wound around the driving output shaft 313, and the other end of the traction cable 304 is connected with the support piece 302. When the lifting shelf needs to move down, an output shaft 3031 of the driving motor 303 is controlled to rotate in a first direction, the traction cable 304 extends out, and the lifting shelf 103 moves down under the action of gravity. When the lifting shelf 103 needs to move up, the output shaft of the driving motor 303 is controlled to rotate in a second direction (opposite to the first direction), the traction cable 305 is gradually wound, and the lifting shelf 103 moves up. Compared with the existing manner of the worm gear mechanism and the screw rod nut mechanism being converted into rectilinear movement, the transmission manner of the shelf driving mechanism using the traction cable is simple in structure and small in occupation space.

In order to help the user to control the lifting shelf 103 to ascend and descend, as shown in FIG. 3, a shelf lifting control button 108 is disposed on a side wall of the storage compartment 100, and the user may control the driving motor to perform forward and reverse rotations by using the shelf lifting control button 108.

In a possible example, the shelf lifting control button 108 includes an up button, a down button and a stop button. The up button is at an upper side and provided with a mark of arrow up, the stop button is at the middle and provided with a mark of stop, and the down button is at a lower side and provided with a mark of arrow down. In another example, the shelf lifting control button 108 includes two buttons, which are an up/stop button and a down/stop button. The up/stop button is used to control the lifting shelf 103 to ascend or stop ascending and the down/stop button is used to control the lifting shelf 103 to descend or stop descending.

In a possible example, in the shelf driving mechanism 300, one guide rail 301 and one support piece 302 are disposed. The guide rail 301 is mounted at a rear side wall of the storage compartment 100, and the support piece 302 is fixedly connected to a middle rear position of the lifting shelf 103. The driving motor 303 is disposed at an upper side of the guide rail 301. In this way, the traction cable 304 will be shorter in traction distance, and thus the structure is simpler and production costs are lower. However, in this example, the lifting shelf 103 is supported and fixed only on the middle position. If the articles placed on both sides differ greatly in weight, the lifting shelf 103 is likely to tilt.

In a possible example, as shown in FIG. 4, in order to enable the lifting shelf 103 to move up and down more stably, two guide rails 301 are disposed, including a first guide rail 301A and a second guide rail 301B, which are at two opposing sides of the storage compartment 100. The first guide rail 301A is slidably connected with a first support piece 302A, and the second guide rail 301B is slidably connected with a second support piece 302B. The driving motor 303 is disposed at a rear side of the storage compartment 100, and a first pulley 305 is fixed on the driving output shaft 313. A second pulley 306 for switching the traction direction of the traction cable is disposed at left and right sides of the storage compartment 100 respectively. Ends of the two traction cables 304 are fixed on the first pulley 305 respectively, and the middle positions of the two traction cables 304 circumvent the second pulleys 306 respectively, and the other ends of the two traction cables 304 are fixed on the first support piece 302A and the second support piece 302B respectively.

Specifically, as shown in FIG. 5, two annular pulley grooves 3053 are formed on a wheel surface of the first pulley 305, and the traction cables 304 for pulling the support pieces 302 at left and right sides respectively are wound into the pulley grooves 3053 respectively.

Figure 6:
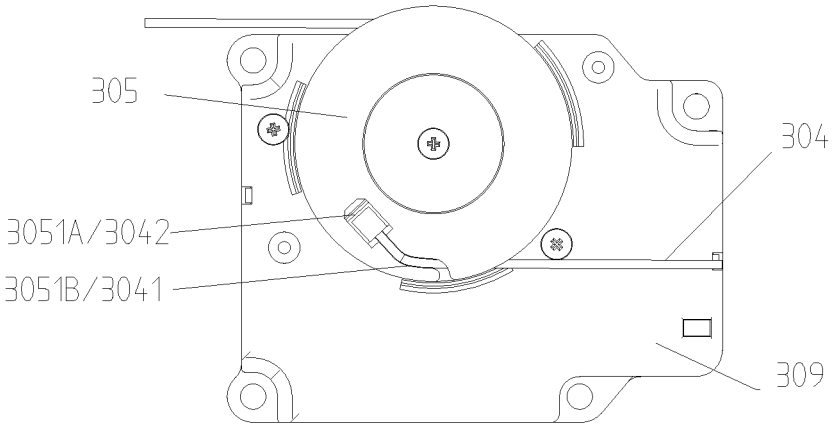
FIG. 6 is a schematic diagram of connection relationship of a traction cable, a first pulley and a motor mounting box according to one or more examples of the present disclosure.
Figure 7:
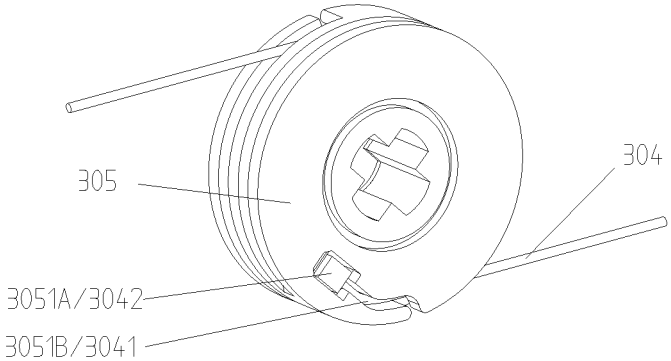
FIG. 7 is a structural schematic diagram of fixed connection of a traction cable and a first pulley according to one or more examples of the present disclosure.

The traction cable 304 and the first pulley 305 may be fixed in several manners. In order to facilitate mounting and dismounting of the traction cable 304, as shown in FIGS. 6 and 7, an inserting groove 3051 for fixing an end of the traction cable is preferably disposed on an end surface of the first pulley 305. The traction cable 304 includes a cable body 3041 and a limiting block 3042 at a side end of the cable body. The inserting groove 3051 includes a limiting groove 3051A mated with the limiting block 3042 and a connection groove 3051B mated with the cable body 3041. An outer end of the connection groove 3051B extends to the pulley groove of the first pulley 305.

FIG. 6 is a schematic diagram of connection relationship of a traction cable, a first pulley and a motor mounting box according to one or more examples of the present disclosure. In some examples, the traction cable is a steel wire rope and a cross section area of the limiting block 3042 is greater than that of the cable body 3041. Illustratively, as shown in FIG. 6, the limiting block 3042 adopts a rectangular block structure with a large cross section area and is integrally welded with the cable body.

In some examples, the limiting groove 3051A is matched in shape and size with the limiting block 3042. A width of the connection groove 3051B is matched with a diameter size of the cable body 3041. The connection groove 3051B extends along an arc on the end surface of the first pulley 305.

The driving motor 303 is mounted into the motor mounting box 309, the driving output shaft 313 protrudes out of a front side of the motor mounting box 309, and the first pulley 305 is fixedly connected with the driving output shaft 313 through a screw.

Figure 8:
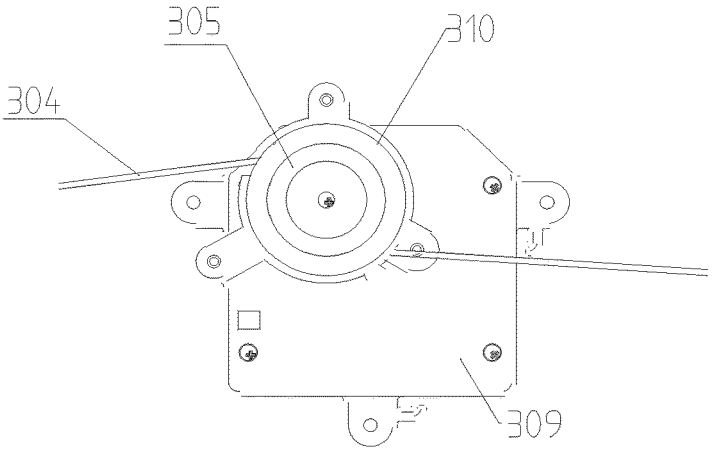
FIG. 8 is a schematic diagram of connection relationship of a covering housing and a motor mounting box according to one or more examples of the present disclosure.
Figure 9:
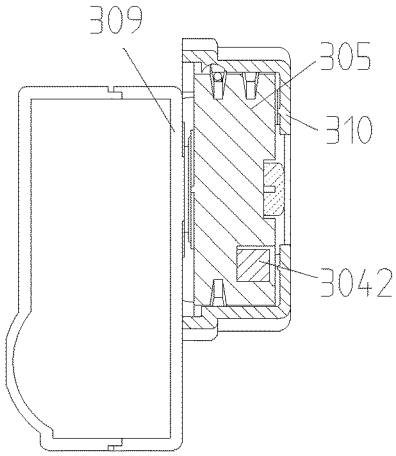
FIG. 9 is a sectional diagram of connection relationship of a covering housing and a motor mounting box according to one or more examples of the present disclosure.

FIG. 8 is a schematic diagram of connection relationship of a covering housing and a motor mounting box according to one or more examples of the present disclosure. FIG. 9 is a sectional view of connection relationship of a covering housing and a motor mounting box according to one or more examples of the present disclosure. As shown in FIGS. 8 and 9, a covering housing 310 covering on the first pulley 305 is disposed at an outer side of the motor mounting box 309, the covering housing 310 is thread-connected to the motor mounting box 309, a mounting hole for inserting the traction cable 304 is disposed on the covering housing 310. In this case, the limiting block 3041 of the traction cable 304 is limited by the covering housing 310 and a front end surface of the motor mounting box 309 respectively along a back and forth direction, and thus will not slide out.

Figure 10:
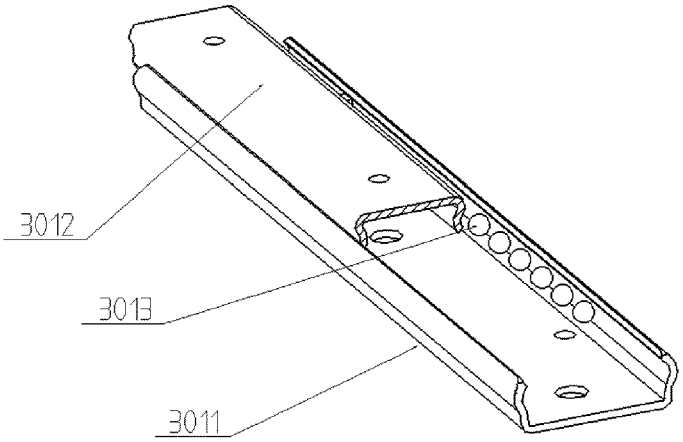
FIG. 10 is structural schematic diagram of a guide rail according to one or more examples of the present disclosure.

FIG. 10 is a structural schematic diagram of a guide rail structure according to one or more examples of the present disclosure. As shown in FIG. 10, the guide rail 301 is a steel ball slide rail, and the steel ball slide rail includes an outer rail 3011, an inner rail 3012, and a rolling ball 3013 therebetween. The outer rail 3011 is fixed at a side wall of the storage compartment 100, and the support piece 302 is fixedly connected with the inner rail 3012. When the above steel ball slide rail is adopted, it is only required to overcome rolling resistance during up and down movement of the lifting shelf 103. Under the same load, only a smaller driving force is required to move up and down the lifting shelf 103.

Figure 11:
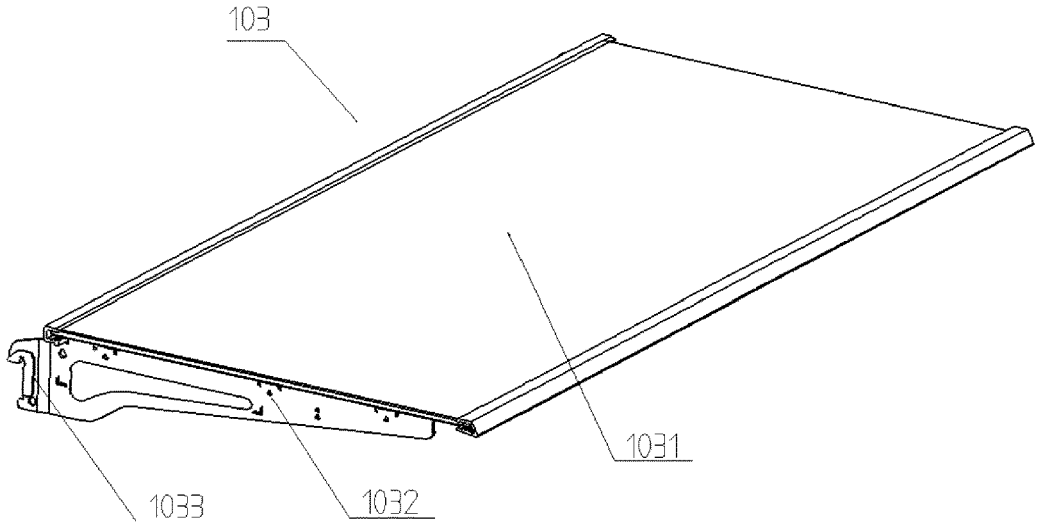
FIG. 11 is a structural schematic diagram of a lifting shelf according to one or more examples of the present disclosure.

The lifting shelf 103 may be fixed on the support piece 302 in several ways, for example, may be fixed by thread fixing or buckling connection. FIG. 11 is a structural schematic diagram of a lifting shelf according to one or more examples of the present disclosure. As shown in FIG. 11, the lifting shelf 103 includes a shelf body 1031 and a shelf support frame 1032 for supporting the shelf body 1031. The shelf support frame 1032 is fixedly connected to both sides of a lower portion of the shelf body 1031, and a hook 1033 is disposed at a rear side of the shelf support frame 1032. A hooking hole 3021 is disposed on the support piece 302. As shown in FIG. 8, the hook 1033 of the shelf support frame 1032 is hooked on the hooking hole 3021 of the support piece 302. Such hooking manner is highly reliably and convenience is provided for the user to dismount the lifting shelf 103 for cleaning.

Figure 12:
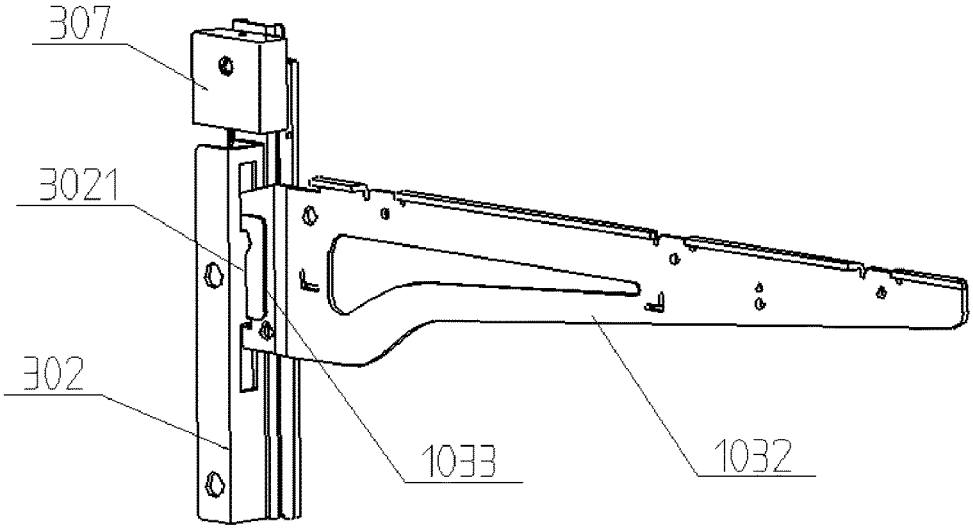
FIG. 12 is a schematic diagram of connection relationship of a lifting shelf and a support piece according to one or more examples of the present disclosure.

The support piece 302 and the traction cable 304 may be fixed in several ways. In one example, a connection hole is formed on an upper side of the support piece 302, and the traction cable 304 is directly connected to the connection hole. In this manner, the support piece 302 fixes the lifting shelf 103 and the traction cable 304 at the same time, thus requiring high supporting capability. FIG. 12 is a schematic diagram of connection relationship of a lifting shelf and a support piece according to one or more examples of the present disclosure. In some examples of the present disclosure, as shown in FIG. 12, a traction cable fixing piece 307 is disposed at an upper side of the support piece 302, and the traction cable fixing piece 307 is fixedly connected to the inner rail 3021. The traction cable fixing piece 307 and the support piece 302 are independent from each other and support the lifting shelf 103 and the traction cable 304 respectively. In this way, the supporting performance can be guaranteed and the manufacturing assembly is made easy at the same time.

During the up and down movement of the lifting shelf 103, it is possible that an article blocks the lifting shelf 103. At this time, it is necessary to stop the lifting shelf 103 immediately to prevent toppling of the articles on the lifting shelf 103 due to the sideway tilt of the lifting shelf 103. Therefore, the shelf driving mechanism 300 further includes an obstruction-encountering emergency stop device for controlling the driving motor to stop when the lifting shelf 103 encounters resistance during its ascent or descent. In order to guarantee the safety of up and down movement of the lifting shelf 103, the obstruction-encountering emergency stop device includes a down obstruction-encountering emergency stop device and an up obstruction-encountering emergency stop device. The down obstruction-encountering emergency stop device is used to ensure that the lifting shelf 103 stops moving down upon encountering resistance during down movement and the up obstruction-encountering emergency stop device is used to ensure that the lifting shelf 103 stops moving up upon encountering resistance during up movement. Specifically, The down obstruction-encountering emergency stop device and the up obstruction-encountering emergency stop device both operate by detecting a current of the driving motor 303. Specifically, a current sensor for detecting a current magnitude is disposed on the driving motor 303. When the lifting shelf 103 encounters resistance during up or down movement, the current of the driving motor 303 will change suddenly. At this time, the controller will control the driving motor to stop running. In the obstruction-encountering emergency stop device, the driving motor is controlled to start and stop by a change threshold of the current. If the threshold is set improperly, for example, the threshold is set to be excessively large, the lifting shelf 103 will not stop in time, and if the threshold is set to be excessively small, the lifting shelf 103 will stop at a position where it shall not stop.

Figure 13:
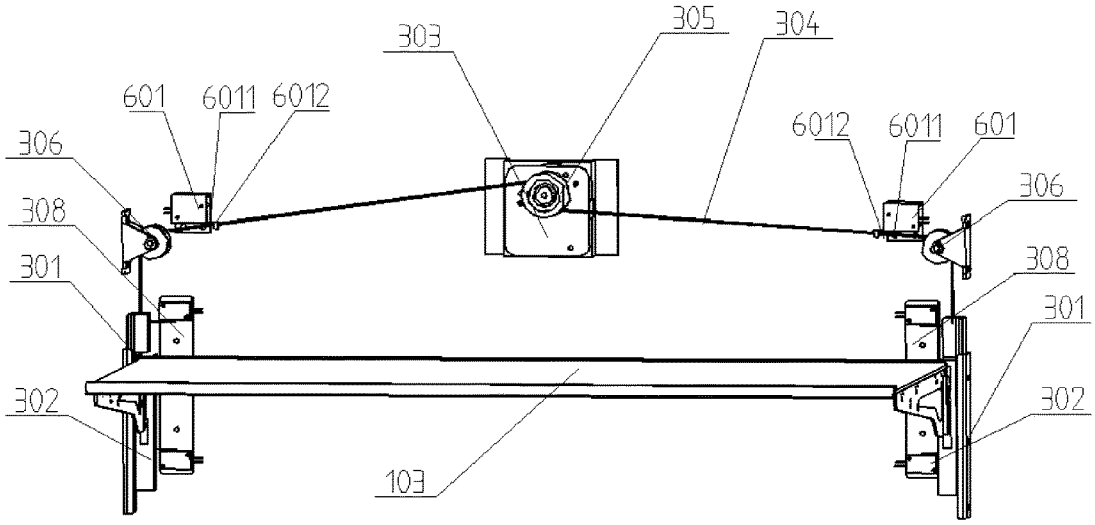
FIG. 13 is a schematic diagram of a shelf driving mechanism with an obstruction-encountering emergency stop device in a case of normal operation according to one or more examples of the present disclosure.
Figure 14:
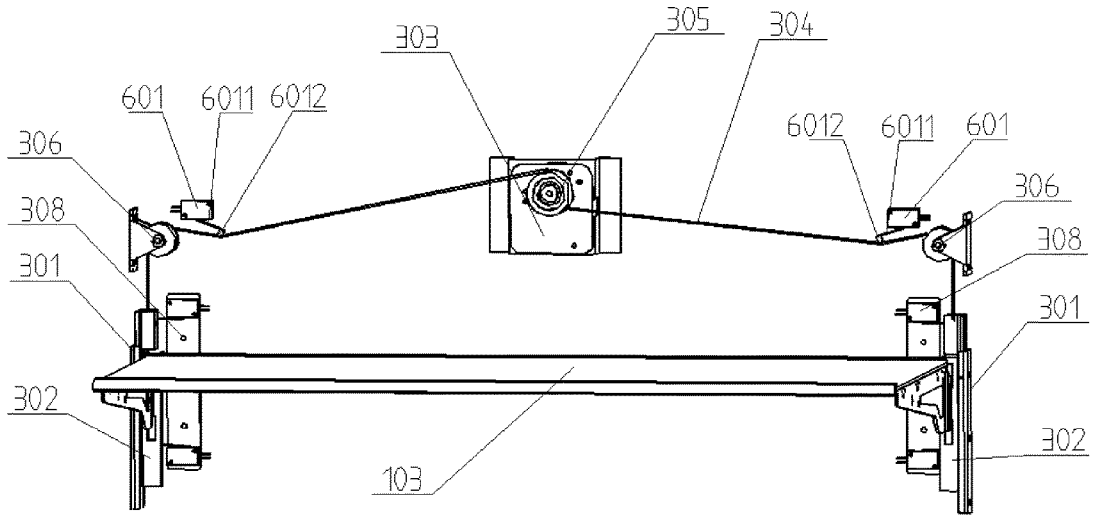
FIG. 14 is a schematic diagram of a shelf driving mechanism with an obstruction-encountering emergency stop device in a case that a shelf is obstructed according to one or more examples of the present disclosure.

FIG. 13 is a schematic diagram of a shelf driving mechanism with an obstruction-encountering emergency stop device in a case of normal operation according to one or more examples of the present disclosure. FIG. 14 is a schematic diagram of a shelf driving mechanism with an obstruction-encountering emergency stop device in a case that a shelf is obstructed according to one or more examples of the present disclosure. In some examples of the present disclosure, in order to provide an obstruction-encountering emergency stop device that can more accurately control the lifting shelf 103 to stop in a case that the lifting shelf 103 encounters resistance, as shown in FIGS. 13 and 14, the down obstruction-encountering emergency stop device includes a microswitch 601, the microswitch 601 is fixed on a rear wall of the cold storage compartment 100B, an annular sleeve 6012 is disposed on a detection arm 6011 of the microswitch 601 and sleeved on the traction cable 304. Preferably, the annular sleeve 6012 is sleeved on the section of the traction cable located between the first pulley 305 and the second pulley 306. As shown in FIG. 13, under normal circumstances, the traction cable 304 is in a tensioned state due to gravity of the lifting shelf 103, the detection arm 6011 of the microswitch 601 keeps consistent in position during normal operation, and the circuit is in a normally-closed state. When the lifting shelf 103 encounters an obstruction during down movement as shown in FIG. 14, the traction cable 304 is changed from the tensioned state into a relaxed state. At this time, the detection arm 6011 of the microswitch 601 changes in position and the circuit is changed from normally closed state to normally-open state. At this time, a control unit cuts off the circuit, the driving motor 303 stop rotating, and the lifting shelf 103 stops moving down. Because the traction cable will have a position change immediately upon encountering an obstruction, the response speed can be increased by detecting the position of the traction cable using the microswitch 601, thereby improving the detection reliability.

Figure 15:
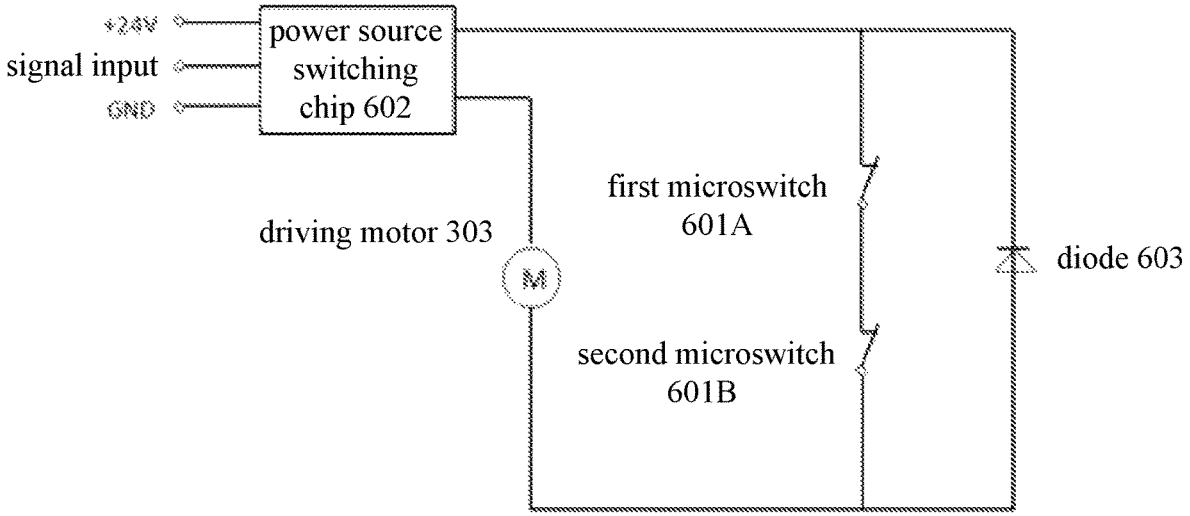
FIG. 15 is a circuit diagram of power source switching signal of an obstruction-encountering emergency stop device according to one or more examples of the present disclosure.

FIG. 15 is a circuit diagram of power source switching signal of an obstruction-encountering emergency stop device according to one or more examples of the present disclosure. A power source switching chip 602 is included to switch polarity of an output end according to signal input information. A first microswitch 601A and a second microswitch 601B at both sides of the traction cable 304 are series-connected with each other and then parallel-connected with a diode 603, and then series-connected with the driving motor 303 and then connected to two output ends of the power source switching chip 602, where a positive pole of the diode 603 is connected with the driving motor 303 and a negative pole of the diode 603 is connected with the power source switching chip 602.

Specifically, an input end of the power source switching chip 602 includes a +24V power interface and a GND end connecting the positive and negative poles of 24V DV power source respectively and a signal input end connecting with I/O port of a single-chip machine sending a switching signal. The two output ends of the power source switching chip are series-connected in the circuit to provide a power signal to the obstruction-encountering emergency stop device. After the signal input end receives a switching signal from the single-chip machine, the power polarities of the two output ends will be exchanged up and down (for example, changing from upper end +24V lower end GND into upper end GND lower end +24V).

When the lifting shelf descends normally, the two output ends of the power source switching chip 602 are upper end +24V lower end GND. At this time, the current of the circuit runs clockwise through the first microswitch 601A and the second microswitch 601B on the two traction cables 304, and then through the driving motor 303, and the driving motor 303 rotates to drive the lifting shelf 103 to descend. At this time, the lifting shelf 103 encounters an obstruction during down movement, thus causing the traction cable 304 to be relaxed. One or two of the first microswitch 601A and the second microswitch 601B will be disconnected, and thus the original circuit will be cut off. In this case, the driving motor 303 stops rotating and the lifting shelf 103 stops descending. At this time, if the down button is depressed again, the lifting shelf 103 will not act, but the lifting shelf 103 can be moved up by depressing the up button. When the up button is depressed, the single chip machine will receive the depressing information and then send a power source switching signal to the power source switching chip 602 through the signal input end. The two output ends of the power source switching chip 602 is switched to upper end GND lower end +24V. At this time, the current of the circuit is counterclockwise. Although the microswitch 601 (the first microswitch 601A and/or the second microswitch 601B) is disconnected, the current can be conducted again through the diode 603 after running through the driving motor 303. Therefore, the driving motor 303 rotates reversely and the lifting shelf 103 ascends. After the lifting shelf 103 ascends a distance, the two microswitches 601A/601B restore to on state, and the down button also restores to normal. At this time, the up and down movements of the lifting shelf can be freely controlled again by the up and down buttons.

Specifically, in order to further accurately control the movement position of the lifting shelf 103, the refrigerator further includes a shelf stroke detection device 700. The shelf stroke detection device 700 is used to detect the highest and lowest movement strokes of the lifting shelf. The control device is used to control the driving motor to start and stop based on a detection signal of the shelf stroke detection device 700. In order to facilitate assembly mounting, the driving motor 303, the gear transmission mechanism and the shelf stroke detection device 700 are mounted into the motor mounting box 309 in an integrated manner. A driving output shaft 313 for outputting the torque of the driving motor 303 protrudes out of the motor mounting box 309. The gear transmission mechanism may be disposed as a gear transmission mechanism of two or three levels according to a reduction ratio, and the gear transmission mechanism is provided with several transmission gears 312.

Figure 16A:
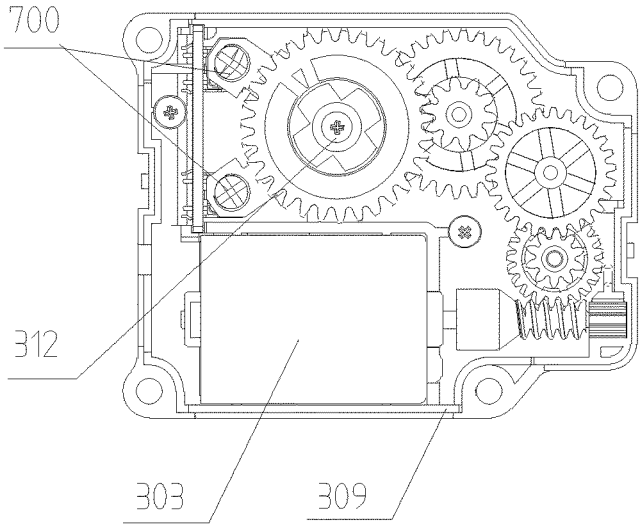
FIG. 16A is a structural schematic diagram of a motor mounting box in an opened state according to one or more examples of the present disclosure.
Figure 16B:
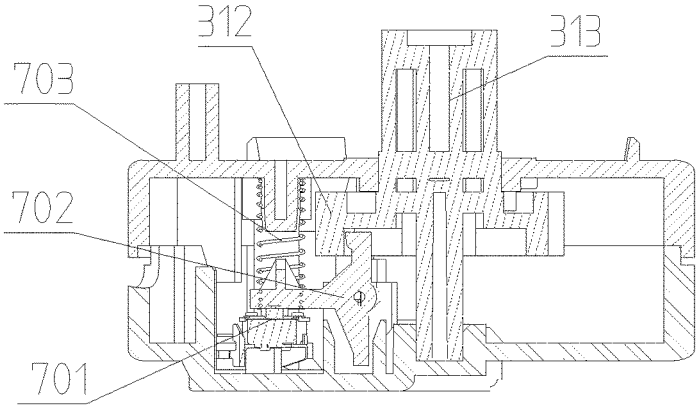
FIG. 16B is a sectional view of a motor mounting box according to one or more examples of the present disclosure.

FIG. 16A is a structural schematic diagram of a motor mounting box in an opened state according to one or more examples of the present disclosure. FIG. 16B is a sectional view of a motor mounting box according to one or more examples of the present disclosure. As shown in FIGS. 16A and 16B, the shelf stroke detection device 700 includes a stroke switch 701 and a linkage piece 702. A trigger portion 7011 is disposed on the stroke switch 701, the linkage piece 702 cooperates with the stroke switch 701 and the transmission gear 312 respectively, and a positioning portion 3121 is disposed on an inner wheel surface of the transmission gear 312. When the driving motor 303 drives the transmission gear 312 to rotate to an extent that the positioning portion 3121 is in contact with the linkage piece 702, the linkage piece 702 triggers the trigger portion 7011 of the stroke switch 701.

Specifically, the transmission gear 312 may be any one transmission gear 312 of the gear transmission mechanism that rotates no more than one turn in a maximum stroke range of the lifting shelf 103. But, subjected to the size of the stroke switch and the arrangement of the motor mounting box, for ease of mounting, the stroke switch is cooperated with the last level of output gears where the driving output shaft is located so as to realize triggering of the highest and lowest strokes of the shelf.

Specifically, the stroke switch 701 is snap-fitted on one side surface of the motor mounting box 309 with its trigger portion 7011 facing the other side surface of the motor mounting box 309. The linkage piece 702 includes a middle hinging portion 7021 through which the linkage piece 702 is swingably connected to the motor mounting box. The linkage piece 702 further includes a first extension arm 7022, a second extension arm 7023 and a third extension arm 7024 extending from the middle hinging portion 7021. The second extension arm 7023 and the third extension arm 7024 are on the same straight line and the first extension arm 7022 is disposed perpendicular to the second extension arm 7023 and the third extension arm 7024. The linkage piece 702 is entirely T-shaped. The first extension arm 7022 is used to cooperate with the transmission gear 312, and the second extension arm 7023 is used to cooperate with the stroke switch 701. A reset spring 703 is disposed between the linkage piece 702 and the motor mounting box 309, and an elastic force of the reset spring 703 is applicable to abutting the linkage piece 702 against the trigger portion 7011 of the stroke switch 701. More specifically, a positioning protrusion 70234A is formed on a surface of the second extension arm 7023 opposed to a cooperating surface of the stroke switch 701, one end of the reset spring 703 is sleeved on the positioning protrusion 70234A and the other end of the reset spring 703 is sleeved on a protrusion rib of the motor mounting box 309.

Figure 17A:
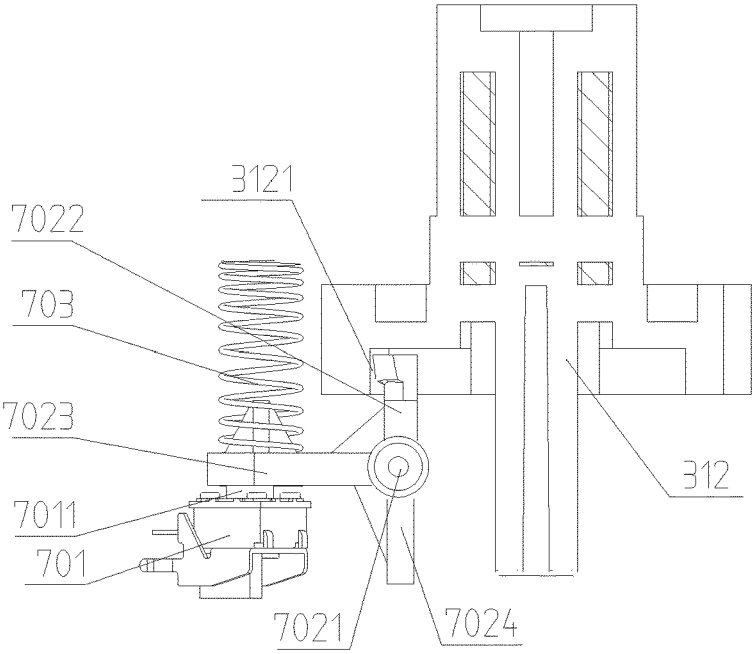
FIG. 17A is a structural schematic diagram of a stroke switch in an un-triggered state according to one or more examples of the present disclosure.
Figure 17B:
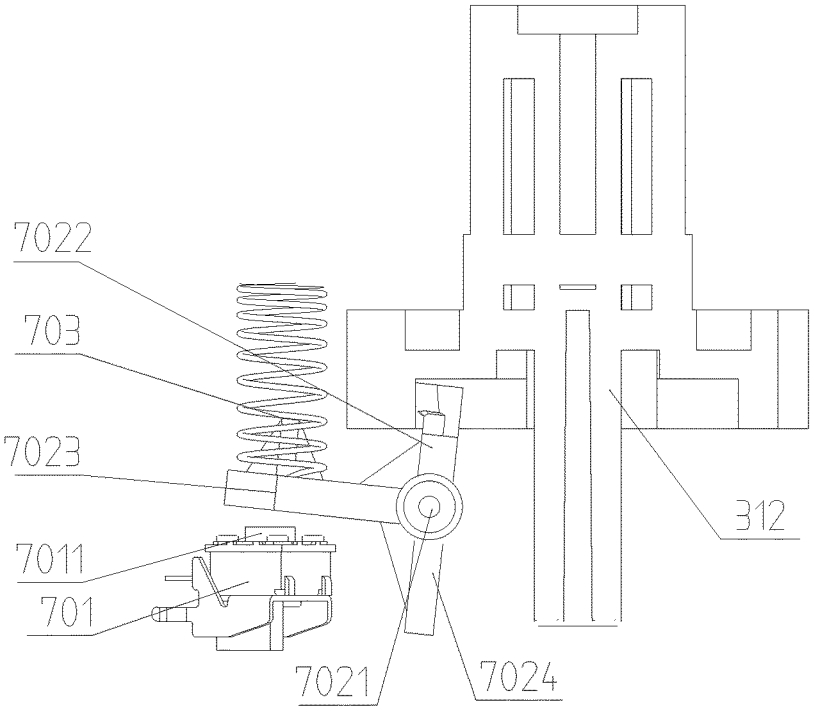
FIG. 17B is a structural schematic diagram of a stroke switch in a triggered state according to one or more examples of the present disclosure.
Figure 18:
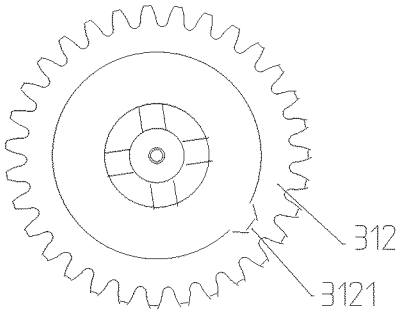
FIG. 18 is a structural schematic diagram of a transmission gear according to one or more examples of the present disclosure.

Specifically, the positioning portion 3121 is a groove formed on the inner wheel surface of the transmission gear 312. As shown in FIG. 17A, when the first extension arm 7022 is mated with the groove, the linkage piece swings around the middle hinging portion 7021 until the second extension arm 7023 is abutted against the trigger portion 7011, so that the stroke switch 701 is triggered. As shown in FIG. 17B, when the first extension arm 7022 is mated with other region of the transmission gear 312 than the groove, the linkage piece 702 swings around the middle hinging portion 7021 until the second extension arm 7023 separates from the trigger portion 7011.

Two shelf stroke detection devices are disposed which are triggered respectively when the lifting shelf moves to the highest and lowest positions. For example, when the transmission gear 312 rotates in the first direction, the lifting shelf 103 moves up. When one of the stroke detection devices is triggered by the transmission gear 312, the control device controls the driving motor 303 to stop and the lifting shelf 103 stops moving. When the transmission gear 312 rotates in a second direction contrary to the first direction, the lifting shelf moves down. When the other of the stroke detection devices is triggered by the transmission gear 312, the control device controls the driving motor 303 to stop and the lifting shelf 103 stops moving.

In order to reduce the space of the storage compartment 100 occupied by the shelf driving mechanism 300, as shown in FIG. 5, a motor mounting groove 106 is formed on a rear wall of the storage compartment 100, a motor reinforcing iron 104 is disposed at an inner side of the rear wall of the storage compartment 100, and the motor mounting box 309 is fixed in the motor mounting groove 106.

Specifically, as shown in FIG. 8, a connection lug is disposed on the motor mounting box 309, and the motor mounting box 309 is connected with the motor reinforcing iron 104 through a bolt inserted through the connection lug. The output shaft 3031 of the driving motor 303 is parallel to the rear wall of the storage compartment 100, so that the size of the motor mounting box 309 along a thickness direction can be reduced further.

Figure 19:
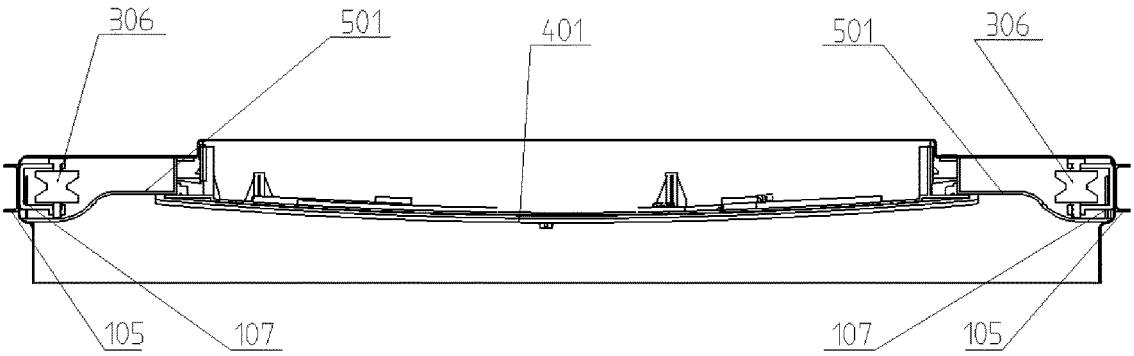
FIG. 19 is a schematic diagram of a cold storage compartment cut along a horizontal direction according to one or more examples of the present disclosure.
Figure 20:
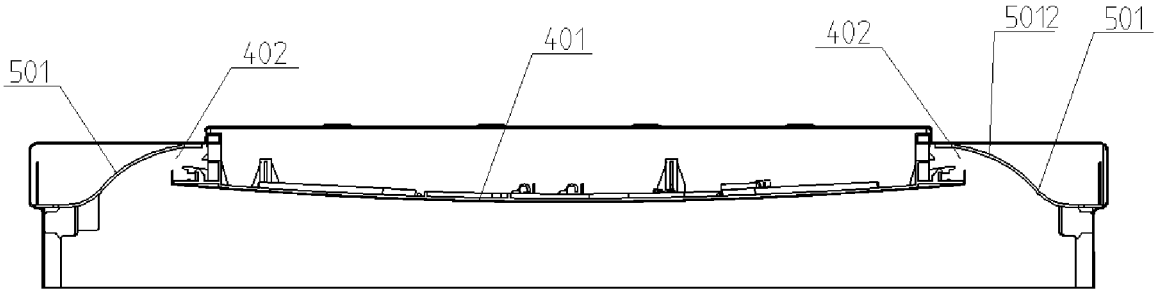
FIG. 20 is another schematic diagram of a cold storage compartment cut along a horizontal direction according to one or more examples of the present disclosure.

FIG. 19 is a schematic diagram of a cold storage compartment cut along a horizontal direction according to one or more examples of the present disclosure. FIG. 20 is another schematic diagram of a cold storage compartment cut along a horizontal direction according to one or more examples of the present disclosure. As shown in FIGS. 19 and 20, a guide rail mounting groove 107 is formed on the left and right side walls of the storage compartment 100 respectively. A guide rail reinforcing iron 105 is disposed at inner sides of the left and right side walls of the storage compartment 100 respectively. The guide rail 301 mounted into the guide rail mounting groove 107 is connected with the guide rail reinforcing iron 105 through a bolt. In this case, two large parts in the shelf driving mechanism 300, i.e. the driving motor 303 and the guide rail 301, are both embedded into the mounting grooves at the inner sides of the inner walls of the storage compartment. Thus, the entire shelf driving mechanism 300 occupies a very small space.

In order to guarantee entire aesthetics of the interior of the storage compartment 100, a decoration structure covering the above shelf driving mechanism 300 is included. Specifically, when the refrigerator is a direct cooling refrigerator, no air duct structure is disposed at the inner side of the storage compartment 100, and one integral panel may be adopted to cover the entire region where the shelf driving mechanism 300 is located. Openings are disposed at both sides of the panel, and the lifting shelf 103 may move up and down along the openings.

In some examples of the present disclosure, the refrigerator 1 is an air cooling refrigerator. As shown in FIGS. 19 and 20, an air duct assembly is disposed at a rear inner wall of the storage compartment 100, the air duct assembly includes an air duct cover plate 401 and air duct foam (not shown). The air duct foam is located at a rear side of the air duct assembly 401, and is connected with a buckle at the rear wall of the cold storage compartment through the air duct cover plate 401. An air duct structure is formed inside the air duct foam. Several air outlets are disposed at both sides of the air duct foam respectively, and the air duct assembly supplies air to the cold storage compartment 100B through the air outlets 402.

The decoration structure covering the above shelf driving mechanism 300 includes two parts. One part of the decoration structure is the air duct cover plate 401 covering upper parts of the driving motor 303 and the traction cable 304. Because the driving motor 303 is mounted at the rear wall of the cold storage compartment 100B, the upper parts of the driving motor 303 and the traction cable 304 can be skillfully covered with the air duct cover plate 401 so that the external entirety in the cold storage compartment is made better. The other part of the decoration structure is a decoration plate 501 covering a region where the guide rail 301 is located. The decoration plate 501 is located at left and right sides of the air duct cover plate 401. As shown in FIGS. 19 and 20, one end of the decoration plate 501 is fitted into the guide rail mounting groove 107, the other end is fixed on the rear wall of the cold storage compartment 100B through two screws, and both sides of the air duct cover plate 401 can cover a part of the decoration plate 501. In this way, the entirety in the storage compartment is maintained, and the problems of external exposure of the guide rail and the pulley assembly and the like and impact of the stored articles on ascent and descent of the lifting shelf and so on are avoided.

The decoration plate 501 has an air guide surface 5014 disposed at the air outlet 402 of the air duct assembly 400 to guide the air supply direction of the air duct assembly. Specifically, the air guide surface 5014 is an inclined surface or an inwardly-recessed arc surface. By disposing the air guide surface 5014 at the air outlet 402, the decoration plate 501 is prevented from blocking the air supply of the air duct assembly 400, thus maintaining the cold storage effect of the cold storage compartment.

Figure 21:
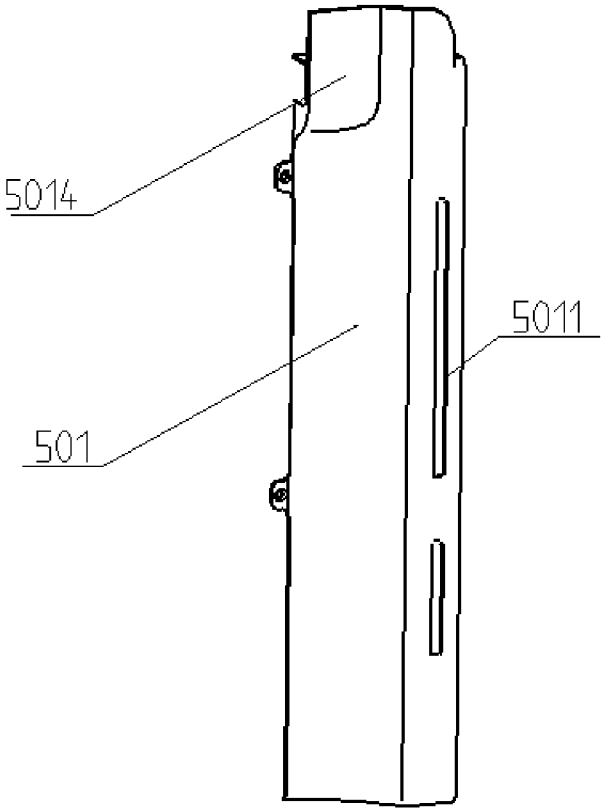
FIG. 21 is a perspective diagram of a decoration plate according to one or more examples of the present disclosure.
Figure 22:
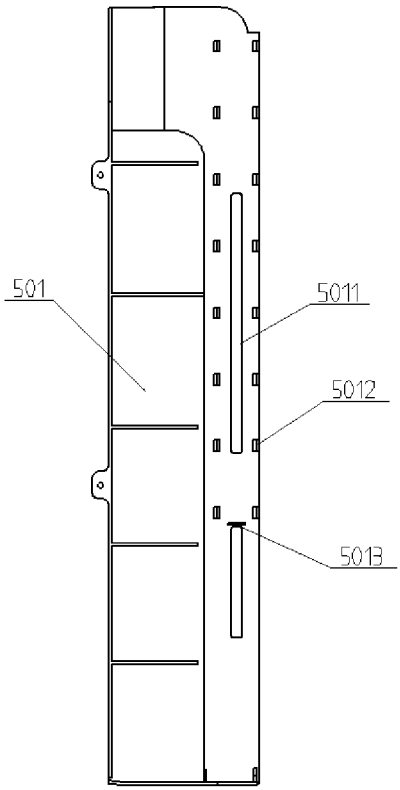
FIG. 22 is a rear view of a decoration plate according to one or more examples of the present disclosure.
Figure 23:
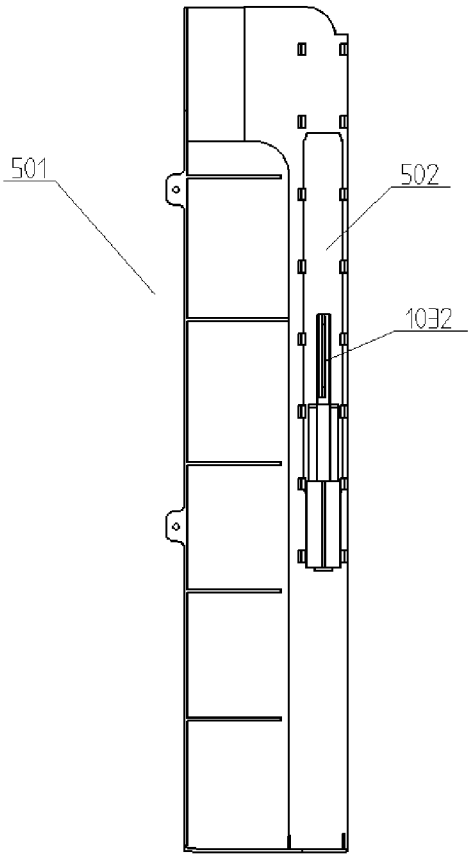
FIG. 23 is a schematic diagram of mating of a decoration plate and a blocking plate according to one or more examples of the present disclosure.

FIG. 21 is a perspective diagram of a decoration plate according to one or more examples of the present disclosure. FIG. 22 is a rear view of a decoration plate according to one or more examples of the present disclosure. FIG. 23 is a diagram of mating of a decoration plate and a blocking plate according to one or more examples of the present disclosure. As shown in FIGS. 21, 22, and 23, a first opening 5011 extending up and down is disposed on the decoration plate 501, the shelf support frame 1032 of the lifting shelf 103 is inserted through the first opening 5011, and the lifting shelf 103 may move up and down along the first opening 5011. In order to avoid that the lifting shelf 103 generates sliding friction with the first opening 5011 during up and down movement, an area of the first opening 5011 is set as slightly larger to prevent contact between the lifting shelf 103 and the first opening 5011. In this case, the shelf driving mechanism disposed insides are exposed through the first opening 5011. When foods in the storage compartment of the refrigerator enter the shelf driving mechanism, the reliability of the shelf driving mechanism will be affected. Therefore, a blocking plate 502 is disposed at a side of the decoration plate 501 away from the lifting shelf 103, a second opening 50214 matched in size with the shelf support frame is disposed at the blocking plate 502, the shelf support frame is inserted into the second opening 50214, and the blocking plate 502 may move along with the lifting shelf 103 and cover at least part of the first opening 5011.

In this case, the blocking plate 502 may block most area of the first opening 5011. When the lifting shelf 103 moves up and down, the blocking plate 502 may move along, and thus will not affect the movement of the lifting shelf. The above blocking structure can avoid the risk that the foreign matters enter due to inside-outside communication. At the same time, the lifting reliability of the lifting shelf 103 is guaranteed.

The blocking plate may be fixed and mounted in several manners, for example, it may be independently and slidably connected to the guide plate at the rear side of the decoration plate. In this manner, entry of foreign matters cannot be thoroughly avoided due to a clearance existing between the blocking plate 502 and the decoration plate 501. Therefore, in this example, the blocking plate is slidably connected to a rear surface of the decoration plate 501. Specifically, a guide portion 5012 is disposed on the decoration plate 501 and the blocking plate may be longitudinally slidably connected to the guide portion 5012.

The structure of the guide portion 5012 may be in other forms as long as the blocking plate 502 can longitudinally slide thereon. As shown in FIG. 22, the guide portion 5012 is preferably several L-shaped guide ribs formed on the decoration plate 501. The L-shaped guide ribs are arranged longitudinally in two rows. The blocking plate 502 is located between the two rows of L-shaped guide ribs. In this manner, when the blocking plate 502 is mounted, the mounting can be completed by outwardly moving the L-shaped guide ribs, thereby bringing convenience to the whole mounting process. Further, the blocking plate 502 can slide more smoothly due to less slide friction area.

In an example, the blocking plate 502 is an integral plate structure with its length greater than about two folds of height of the first opening. In this case, the blocking plate 502 always covers the first opening 5011 when the lifting shelf 103 is at the lowest or highest positions.

Figure 24:
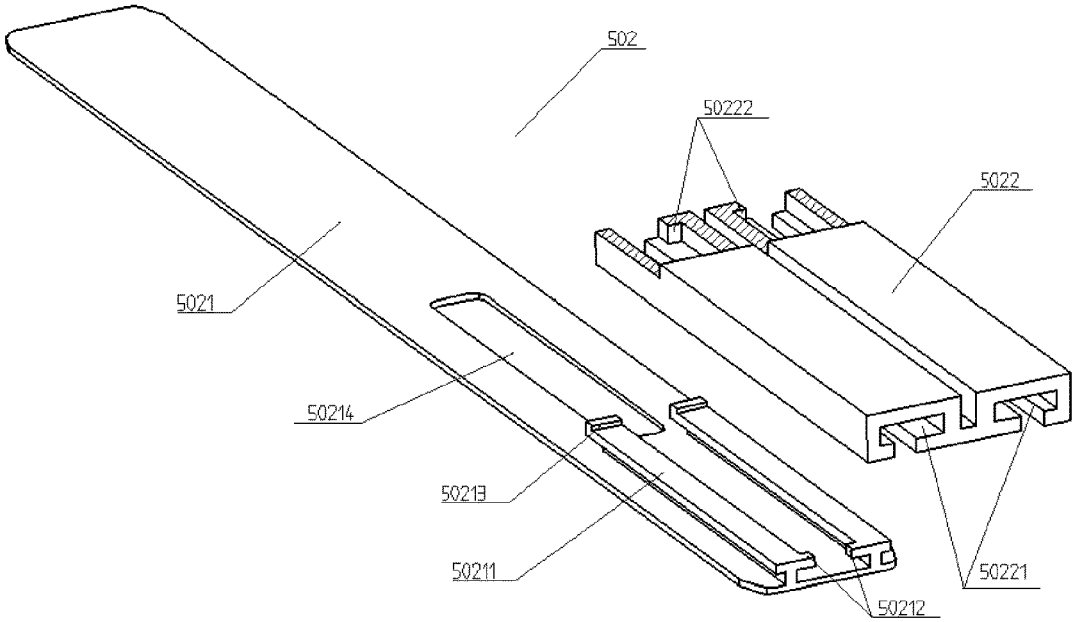
FIG. 24 is an exploded view of a blocking plate according to one or more examples of the present disclosure.

Because the lifting shelf 103 has a large lifting distance, if the blocking plate 502 is designed as an integral plate, when the lifting shelf moves down to the lowest position, the lower end of the blocking plate 502 protrude much downwardly, affecting the fixing of the fixed shelves 102 of lower level, or when the lifting shelf moves up to the highest position, the upper end of the blocking plate 502 protrude much upwardly, abutting against the top wall of the storage compartment. As shown in FIG. 24, the blocking plate 502 includes a first blocking plate 5021 and a second blocking plate 5022 mutually slidably connected, the second opening 50214 is disposed on the first blocking plate 5021, and the second blocking plate 5022 is located at the upper side and/or the lower side of the second opening 50214. When the second blocking plate 5022 is at the upper side of the second opening 50214, a high position limiting portion (not shown) for limiting the highest position of the second blocking plate 5022 is disposed at the decoration plate 501. When the second blocking plate 5022 is at the lower side of the second opening 50214, a low position limiting portion for limiting the lowest position of the second blocking plate 5022 is disposed at the decoration plate 501.

In this case, by disposing the first blocking plate 5021 and the second blocking plate 5022 that are mutually slidable, the high position limiting portion limits the highest position of the second blocking plate 5022 when the lifting shelf 103 moves up. The second blocking plate 5022 slides to the inner side of the first blocking plate 5021, avoiding the risk that the second blocking plate 5022 continues moving up to be abutted against the top wall of the storage compartment. When the lifting shelf 103 moves down, the low position limiting portion limits the lowest position of the second blocking plate 5022. The second blocking plate 5022 slides to the inner side of the first blocking plate 5021, avoiding the risk that the second blocking plate 5022 continues moving down to interfere with the support device of the lower fixed shelves.

In one possible example, the high position limiting portion or the low position limiting portion 5013 is a limiting rib formed on the decoration plate 501.

Figure 25:
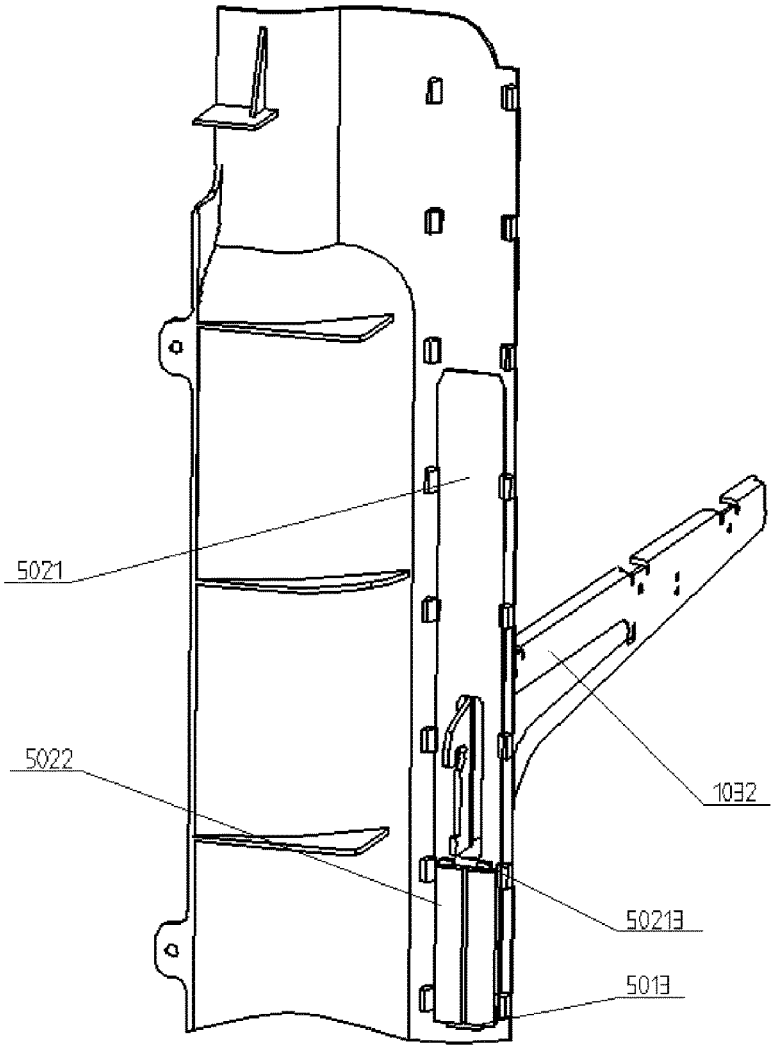
FIG. 25 is a diagram of a state of a blocking plate when a shelf is at the lowest position according to one or more examples of the present disclosure.
Figure 26:
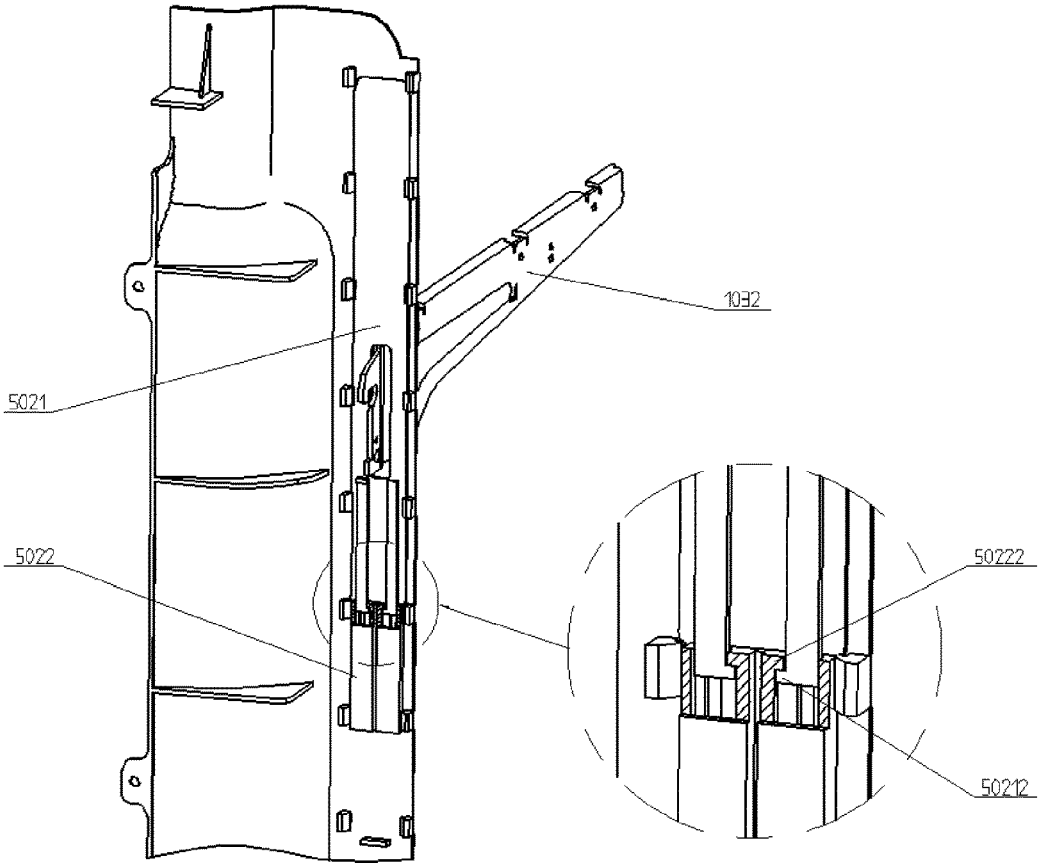
FIG. 26 is a diagram of a state of a blocking plate when a shelf is at the highest position according to one or more examples of the present disclosure.
Figure 27:
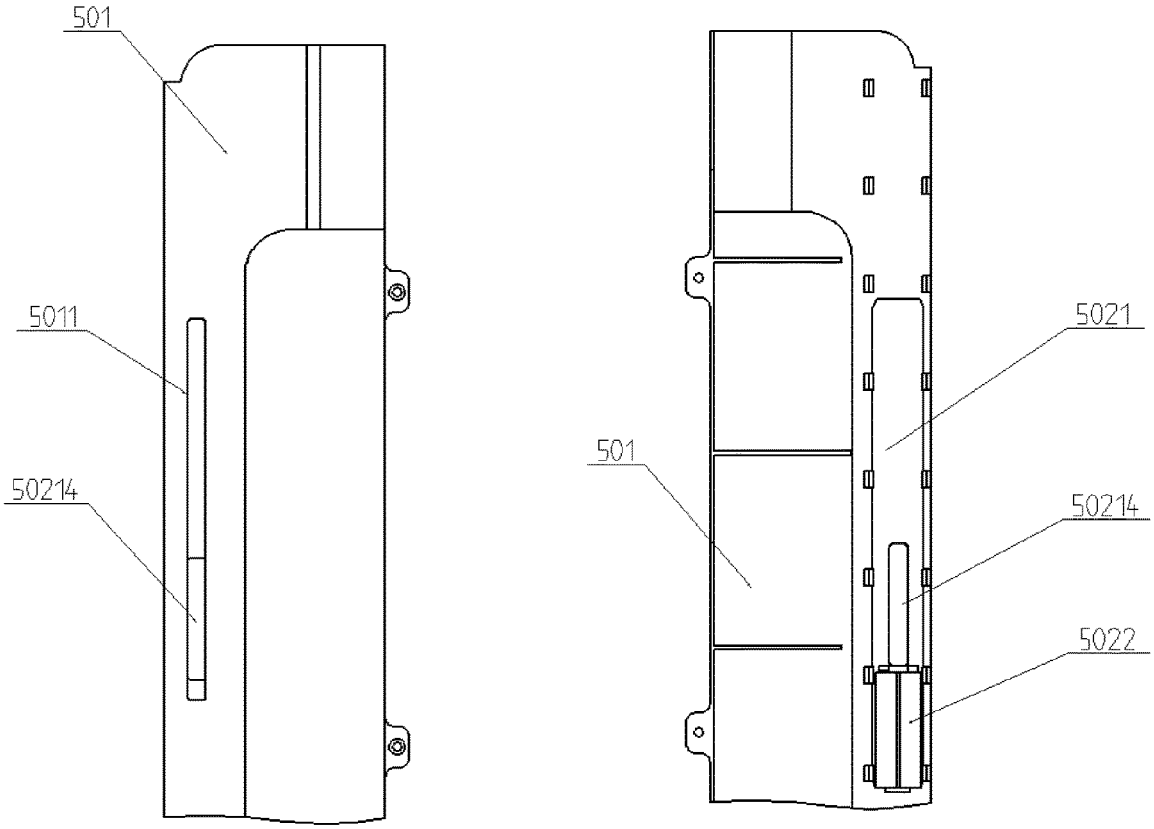
FIG. 27 is front and back views of a decoration plate and a blocking plate when a shelf is at the lowest position according to one or more examples of the present disclosure.
Figure 28:
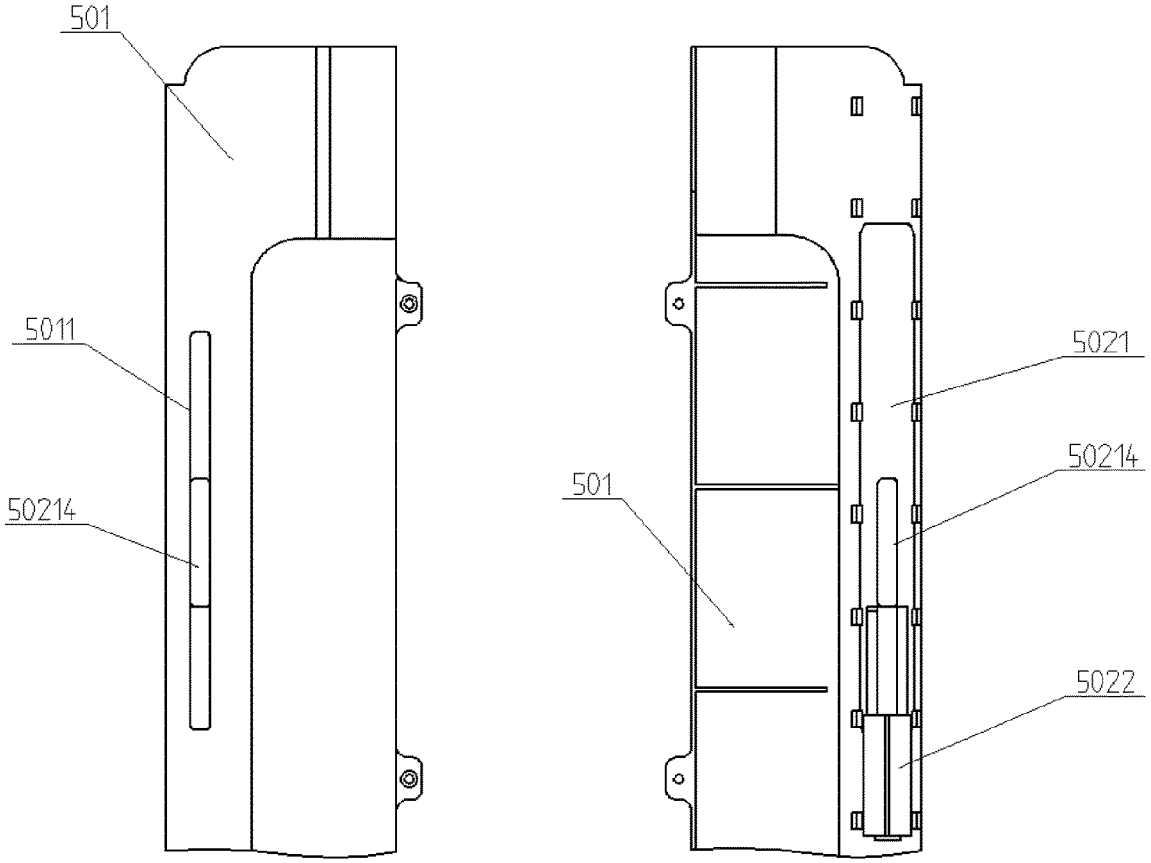
FIG. 28 is front and back views of a decoration plate and a blocking plate when a shelf is at a middle position according to one or more examples of the present disclosure.
Figure 29:
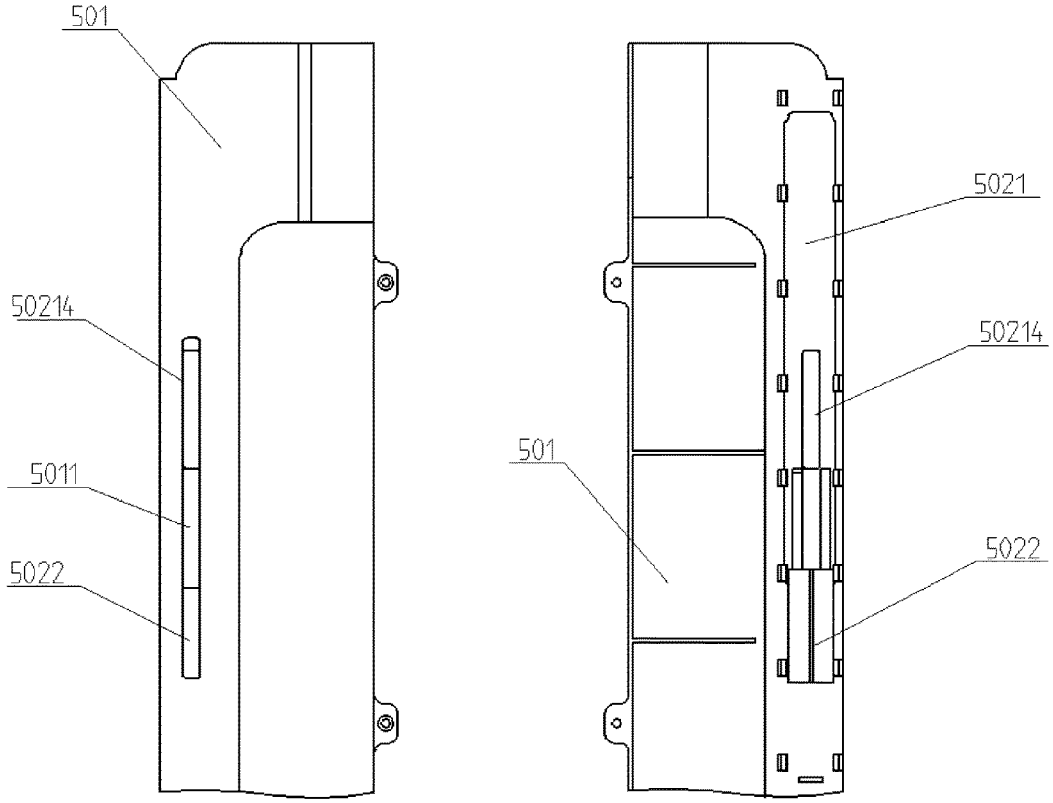
FIG. 29 is front and back views of a decoration plate and a blocking plate when a shelf is at the highest position according to one or more examples of the present disclosure.

FIG. 24 is an exploded view of a blocking plate according to one or more examples of the present disclosure. FIG. 25 is a diagram of a state of a blocking plate when a shelf is at the lowest position according to one or more examples of the present disclosure. FIG. 26 is a diagram of a state of a blocking plate when a shelf is at the highest position according to one or more examples of the present disclosure. FIG. 27 is front and back views of a decoration plate and a blocking plate when a shelf is at the lowest position according to one or more examples of the present disclosure. FIG. 28 is front and back views of a decoration plate and a blocking plate when a shelf is at a middle position according to one or more examples of the present disclosure. FIG. 29 is front and back views of a decoration plate and a blocking plate when a shelf is at the highest position according to one or more examples of the present disclosure.

In some examples of the present disclosure, as shown in FIGS. 23-29, the relationship and working process are described with the second blocking plate 5022 being at the lower side of the second opening 50214 as an example. It is apparent for those skilled in the art that there is the same working principle with the second blocking plate 5022 being at the upper side of the second opening 50214. Thus the descriptions will not be repeated herein.

In order to further limit the sliding position of the second blocking plate 5022, a first limiting portion and a second limiting portion are disposed on the first blocking plate 5021 and the second blocking plate 5022 respectively. As shown in FIG. 25, when the first blocking plate 5021 moves close to the second blocking plate 5022, the first limiting portion cooperates with the low position limiting portion to limit the second blocking plate 5022 to a first position; as shown in FIG. 26, when the first blocking plate 5021 moves away from the second blocking plate 5022, the second limiting portion limits the second blocking plate 5022 to a second position.

Specifically, as shown in FIG. 24, a sliding rib 50211 is disposed at the lower side of the second opening 50214 of the first blocking plate 5021, and a sliding groove 50221 mated with the sliding rib is disposed at the second blocking plate 5022. The first limiting portion includes a limiting protrusion 50213 at an upper end of the sliding rib. When the lower end surface of the second blocking plate 5022 cooperates with the low position limiting portion 5013, the limiting portion 50213 cooperates with the upper end surface of the second blocking plate 5022 to limit the second blocking plate 5022 to the first position as shown in FIG. 25. The second limiting portion includes a first stop 50212 disposed at a lower end of the sliding rib 50211 and a second stop 50222 at an upper end of the sliding groove 50221. The first stop 50212 and the second stop 50222 cooperate to limit the second blocking plate 5022 to the second position as shown in FIG. 26.

FIGS. 27-29 are structural diagrams of front and back sides of a decoration plate 501 when a lifting shelf 103 moves from the lowest position to the middle position and to the highest position. As shown in FIG. 27, when the lifting shelf 103 is at the lowest position, the second opening 50214 is at the lowest position, the second blocking plate 5022 slides to the inner side of the first blocking plate 5021, the lower end surface of the second blocking plate 5022 and the low position liming portion 5013 are cooperated and the limiting protrusion 50213 and the upper end surface of the second blocking plate 5022 are cooperated so that the second blocking plate 5022 is limited to the first position. As shown in FIG. 28, when the lifting shelf 103 is at the middle position, the second opening 50214 is at the middle position, the first blocking plate 5021 slides relative to the second blocking plate 5022 so that the second blocking plate 5022 is at an outer side of the first blocking plate 5021 and the first stop 50212 and the second stop 50222 cooperate to limit the second blocking plate 5022 to the second position. As shown in FIG. 29, when the lifting shelf 103 is at the highest position, the second opening 50214 is at the highest position, and the first blocking plate 5021 brings the second blocking plate 5022 upward to the highest position.

Specifically, two T-shaped sliding grooves 50221 are disposed on the second blocking plate 5022, and two T-shaped sliding ribs 50211 are disposed correspondingly on the first blocking plate 5021.

Obviously, the above examples are only used to clearly describe the present disclosure rather than limit the present disclosure. Those skilled in the prior art may make different types of other changes or modifications based on the above descriptions. All examples are not necessarily or cannot be exhausted herein. All apparent changes or modifications derived herein still fall within the scope of protection of the present disclosure.

The invention claimed is:

1. A refrigerator with a lifting shelf, comprising: a storage compartment, wherein a lifting shelf, a shelf driving mechanism for driving the lifting shelf to move up and down and a shelf stroke detection device for detecting a maximum moving stroke of the lifting shelf are disposed in the storage compartment, the shelf driving mechanism comprises: a driving motor and a gear transmission mechanism, wherein the gear transmission mechanism comprises at least one group of transmission gears, the driving motor outputs a torque by a driving output shaft and a first pulley is disposed on the driving output shaft; a guide rail fixed in the storage compartment, wherein the guide rail is slidably connected to a support piece on the guide rail, and the lifting shelf is fixedly connected with the support piece; and a traction cable, where the traction cable is wound around the first pulley, and the other end of the traction cable is fixedly connected with the support piece;

the shelf stroke detection device comprises: a stroke switch wherein a trigger portion is disposed on the stroke switch; and a linkage piece wherein the linkage piece cooperates with the stroke switch and the transmission gear respectively, a positioning portion is disposed on an inner wheel surface of the transmission gear, and when the driving motor drives the transmission gear to rotate until the positioning portion is in contact with the linkage piece, the linkage piece triggers the trigger portion of the stroke switch.

2. The refrigerator according to claim 1, wherein the driving motor, the gear transmission mechanism and the shelf stroke detection device are mounted in a motor mounting box.

3. The refrigerator according to claim 2, wherein the stroke switch is fitted at a side surface of the motor mounting box, the linkage piece is swingably connected to the motor mounting box, a reset spring is disposed between the linkage piece and the motor mounting box, and an elastic force of the reset spring is applicable to abutting the linkage piece against a trigger portion of the stroke switch.

4. The refrigerator according to claim 3, wherein the linkage piece comprises a middle hinging portion, and a first extension arm and a second extension arm extending outwardly from the middle hinging portion, the first extension arm is used to cooperate with the transmission gear, the second extension arm is used to cooperate with the stroke switch, and a positioning protrusion for fixing the reset spring is formed on a surface of the second extension arm opposed to a cooperating surface of the stroke switch.

5. The refrigerator according to claim 4, wherein the positioning portion is a groove formed on the inner wheel surface of the transmission gear, and when the first extension arm cooperates with the groove, the linkage piece swings around the middle hinging portion until the second extension arm abuts against the trigger portion; when the first extension arm cooperates with other region of the inner wheel surface, the linkage piece swings around the middle hinging portion until the second extension arm separates from the trigger portion.

6. The refrigerator according to claim 4, wherein two shelf stroke detection devices are disposed, and the two shelf stroke detection devices are triggered respectively when the lifting shelf moves to the highest position and the lowest position.

7. The refrigerator according to claim 1, wherein the guide rail comprises a first guide rail and a second guide rail fixed on opposing sides of the storage compartment respectively, the first guide rail is slidably connected with a first support piece, and the second guide rail is slidably connected with a second support piece; second pulleys for converting a traction direction of traction cables are disposed on left and right sides of the storage compartment respectively, ends of the two traction cables are fixed on an inserting groove of the first pulley respectively, the middle positions of the two traction cables circumvent the second pulleys at both sides of the storage compartment respectively, and the other ends of the traction cables are fixed on the first support piece and the second support piece respectively.

8. The refrigerator according to claim 1, wherein the traction cable comprises a cable body and a limiting block at a side end of the cable body, the inserting groove for fixing the end of the traction cable is disposed at an end surface of the first pulley, the inserting groove comprises a limiting groove mated with the limiting block and a connection groove mated with the cable body, a free end of the connection groove extends to a pulley groove of the first pulley for winding the traction cable, and a cross section area of the limiting block is greater than a cross section area of the cable body.

9. The refrigerator according to claim 8, wherein the limiting groove is matched in shape and size with the limiting block, a width of the connection groove is matched with a diameter size of the cable body, and the connection groove extends along an arc on an end surface of the first pulley.

10. The refrigerator according to claim 6, wherein a covering housing covering the first pulley is disposed at an outer side of the motor mounting box, the covering housing is thread-connected to the motor mounting box, and a mounting hole for inserting the traction cable is disposed on the covering housing.

* * * * *